US005113634A

United States Patent [19]

Lüthi

[11] Patent Number: 5,113,634

[45] Date of Patent: May 19, 1992

[54] METHOD OF PRODUCING A TENSION PART ANCHORABLE IN THE EARTH

[75] Inventor: Kurt Lüthi, Gwatt, Switzerland

[73] Assignee: VSL International AG, Bern, Switzerland

[21] Appl. No.: 370,771

[22] Filed: Jun. 23, 1989

[30] Foreign Application Priority Data

Jul. 6, 1988 [CH] Switzerland ..... 2581

[51] Int. Cl.[5] ..... E04G 21/00; E04C 5/08

[52] U.S. Cl. ..... 52/741; 52/223 L; 52/230

[58] Field of Search ..... 52/225, 226, 230, 741, 52/223 L; 29/452

[56] References Cited

U.S. PATENT DOCUMENTS 3,936,924 2/1976 Ichise et al. ..... 52/166
4,069,677 1/1978 Yamada et al. ..... 61/39
4,719,658 1/1988 Kriofske ..... 52/223 L

FOREIGN PATENT DOCUMENTS 244353 11/1987 European Pat. Off. ..... 52/230

*Primary Examiner*—Michael Safavi
*Attorney, Agent, or Firm*—Oldham, Oldham & Wilson Co.

[57] ABSTRACT

The tension part (1), which can be extracted from the earth after use, comprises a central member (2) and a plurality of outer members (3). At least one (3') of the outer members is completely servered. Pressed on radially about the tension part is a tubular supporting element (5). The point of severance (4) is situated in the entry region of the supporting element. Disposed between the supporting element and the tension part is an insert (11) having inner teeth (13) for a secure grip. Through the severance of one of the outer members, substantially greater ductility is achieved before breakage takes place. This in turn allows better monitoring of soil anchors produced with such tension parts.

3 Claims, 3 Drawing Sheets

METHOD OF PRODUCING A TENSION PART ANCHORABLE IN THE EARTH

Figure 1:
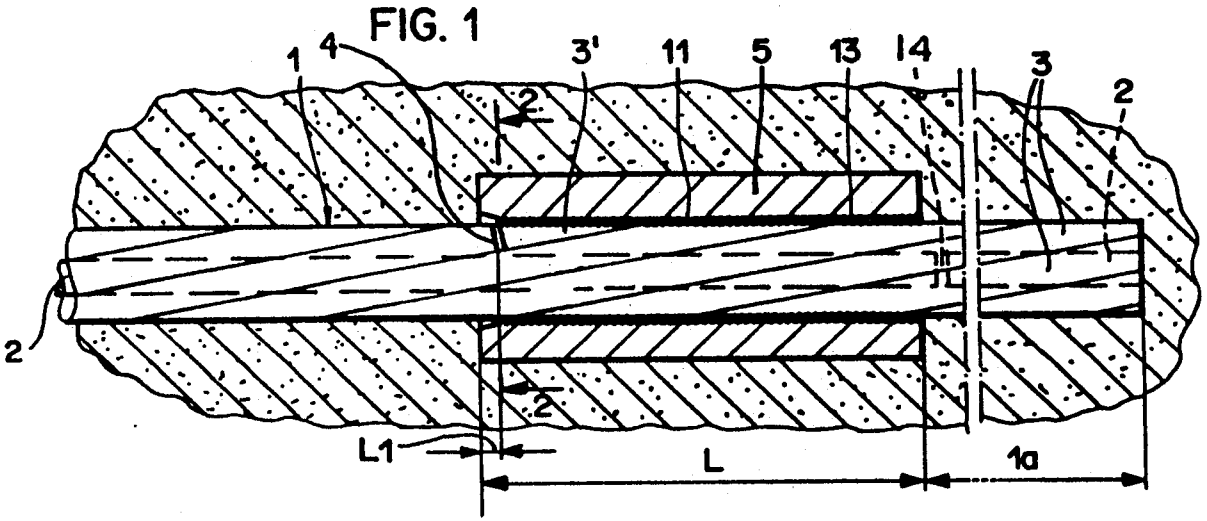

This invention relates to construction equipment, and more particularly to a method of producing a tension part anchorable in the earth or in a structure and capable of being stressed, having a central member about which outer members are disposed, which tension part is intended to be removed for the most part from the earth or the structure after use. The invention further relates to a tension part produced by the foregoing method, of the type having a supporting element surrounding it and at least one completely severed outer member.

For the construction of edifices extending several floors down into the ground, excavations are frequently surrounded by a subterranean curtain or sheet piling and anchored at the rear by means of soil anchors with tension parts. The tension parts are temporarily anchored in the earth at the soil anchors. However, the tension parts may also be used in the structures themselves, as is the case in the supporting of a bridge, for example. There, during construction of the bridge, the supports may be acted upon by forces requiring their temporary reinforcement by tension parts.

After use, the tension parts are removed from the earth or the structure and may possibly be reused. For mechanical extraction, the principle of a breaking point on the tension part is utilized. By means of the breaking point, a reduction in the cross-section of the tension part is achieved. This method is usually limited to rod-shaped steel tension parts having a single traction rod. The tension part is torn off at the breaking point by overstressing beyond the limit of tensile strength and removed for the most part from the earth or the structure.

U S. Pat. No. 4,069,677 describes a soil anchor having a tension part surrounded by an encasing tube. The tension part in the form of a stranded steel wire extends slidingly through the tube; it is led through an anchor plate by its earth-side end and held by means of a sheath braced against the anchor plate. An adhesive is disposed as an intermediate layer between the sheath and the tension part, which is pressed fast by the sheath. The tension load of the sheath is so calculated that the maximum resistance necessary for extracting the tension part is somewhat greater than the load exerted upon the tension part. The drawback of this removable anchor is that the adhesive must be so measured and of such composition that its load capacity is indeed situated between the limits of the working load and the breaking strength. However, the range of tolerance during its production is very narrow, and any inaccuracy can magnify the uncertainty factor of the load capacity of this prior art soil anchor.

In the present assignee's related U.S. Pat. No. 4,884,377, a tension part anchorable in and removable from the earth or a structure is described. This tension part consists of a central member and several outer members surrounding the same. In this prior art tension part, the central member is always completely severed at one point, and a supporting element is pressed around the tension part over this point of severance. By displacing the point of severance within the supporting element, the working load to be exerted upon the tension part can be adapted to the needs. This tension part having a severed central member within the supporting element is very suitable. when there are no great requirements for sufficient or set ductility.

It is an object of this invention to provide an improved method of producing a removable tension part by which such a part having greater ductility can be easily made.

To this end, the method according to the present invention comprises the steps of completely severing at least one of the outer members of the tension part at a first pre-determined point completely severing the central member of the tension part at a second pre-determined point and pressing a supporting element substantially in a radial direction about the tension part in such a way that the point of severance lies within a range extending over approximately the length of the support element, the middle of the range being situated at the end of the support element remote from the rearward end of the tension part.

In the tension part according to the present invention, of the type initially mentioned, the point of severance of said outer member is situated in a range overlapping the front end of the supporting element, and the range is approximately as long as the supporting element.

Figure 2:
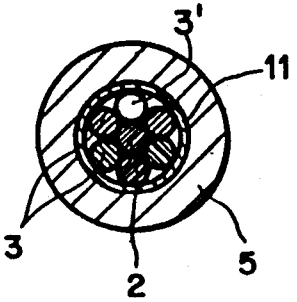
Figure 3:
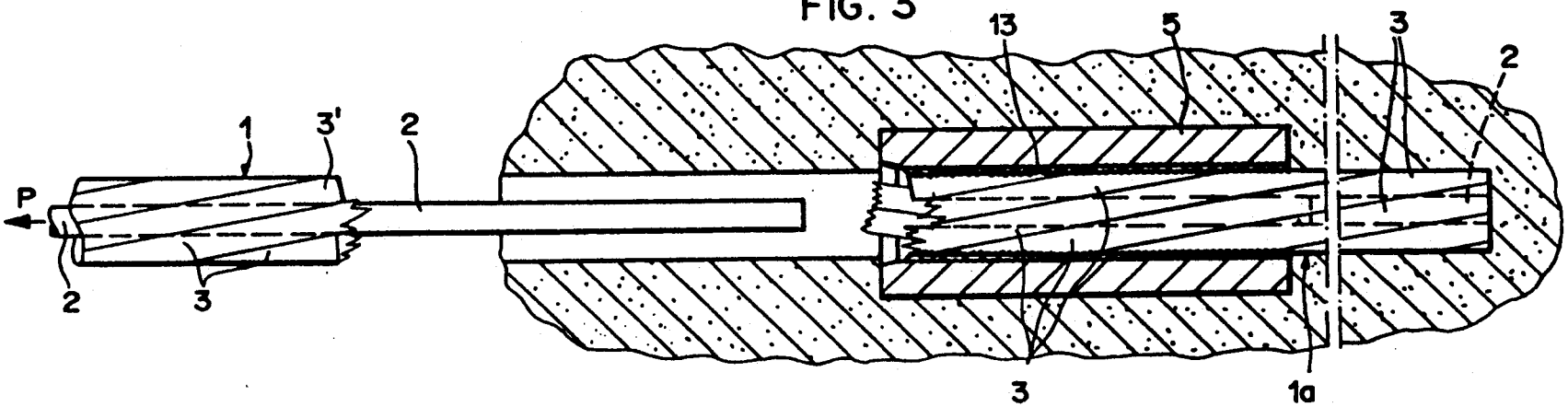
Figure 4:
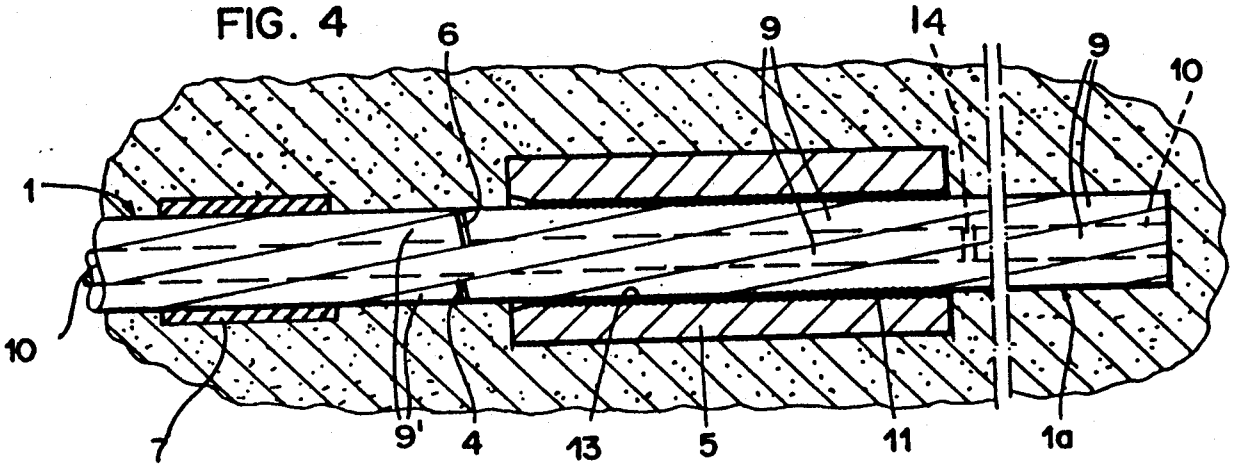
Figure 5:
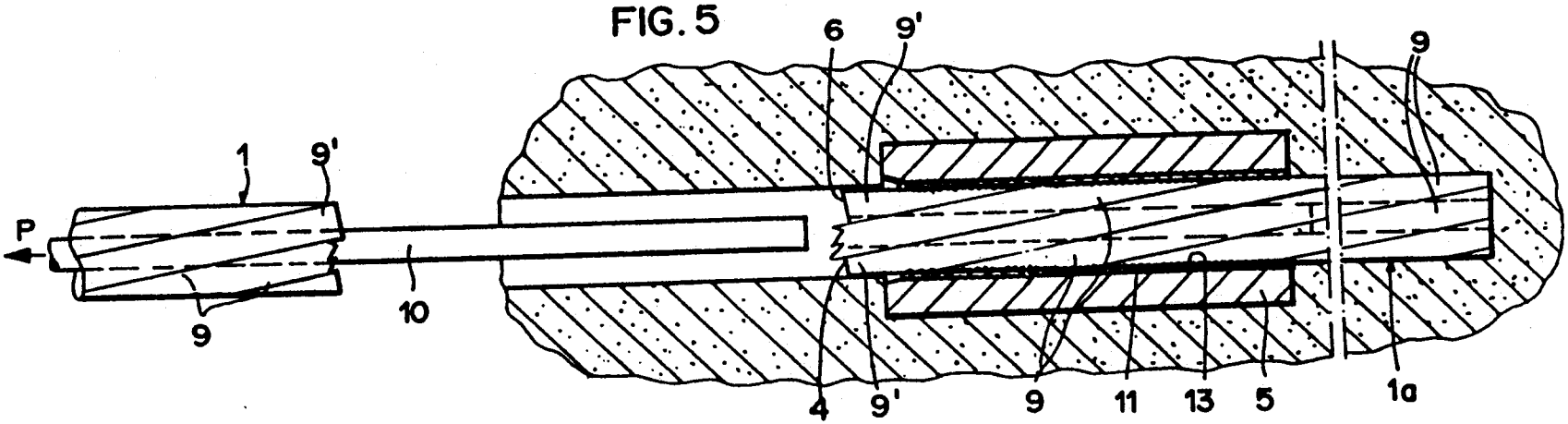
Figure 6:
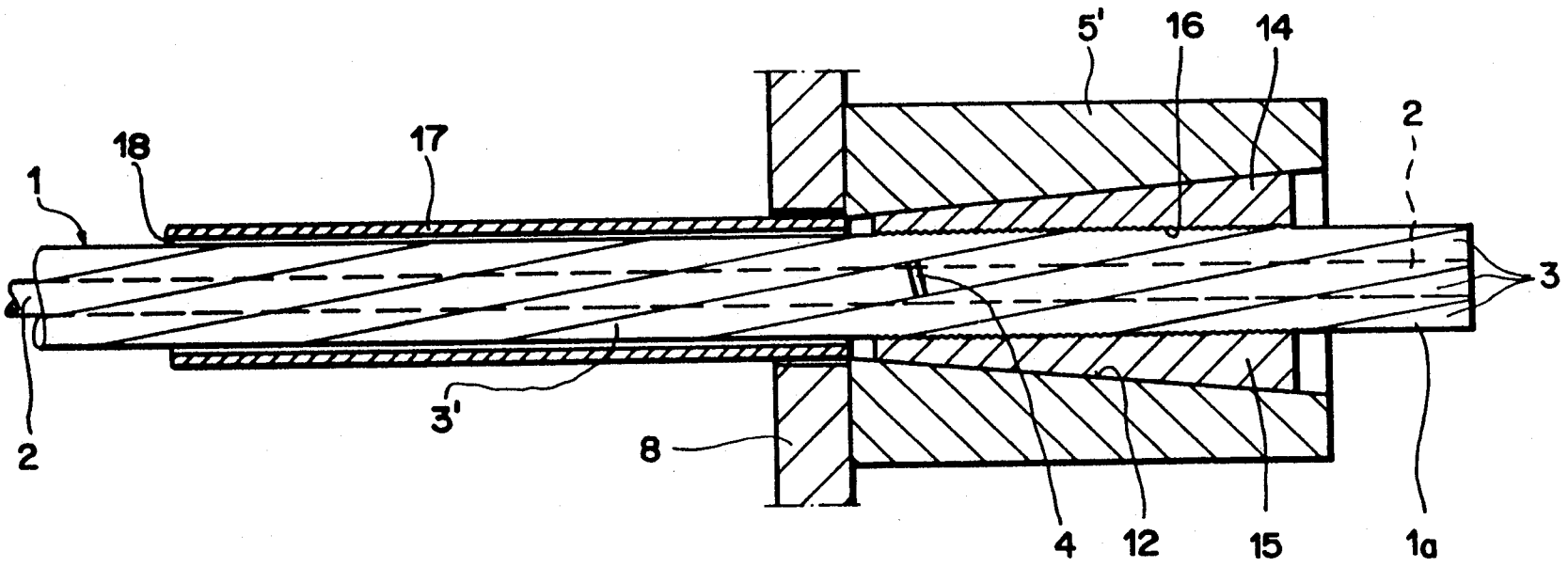

Preferred embodiments of the invention will now be described in detail with reference to the accompanying drawings, in which:

FIG. 1 is a sectional view of a portion of a tension part comprising a stranded steel wire, one of the outer members of which has been completely severed, and having a supporting element just encompassing the point of severance the central member being severed on the side of the support element near to the end of the tension part, FIG. 2 is a section taken on the line 2—2 of FIG. 1, FIG. 3 a partial sectional view of the tension part of FIG. 1 broken apart at the point of severance of the outer member, FIG. 4 is a sectional view of a portion of a tension part comprising a central rod and several parallel steel rods concentric therewith, two of the outer members being completely severed, and having a supporting element pressed about the tension part behind the points of severance, and the central member being severed on the side of the supporting element near the end of the tension part;

FIG. 5 is a partial sectional view of the tension part of FIG. 4 broken apart at the two points of severance, and FIG. 6 is a partial sectional view of a tension part comprising a stranded steel wire, one of the outer members being completely severed, and having a supporting element in the form of a wedge-type anchoring pressed on about the point of severance.

For producing a tension part 1 to be anchored in the earth or in a structure and subjected to a load, as depicted in FIGS. 1 and 2 and intended to be removed for the most part from the earth or the structure after use, the procedure is as follows:

The tension part 1 comprises a stranded steel wire. Of the outer members 3 disposed about a central member 2, one, 3', is completely severed at a point 4. For this purpose, the twisted outer members 3 consisting of wires are partially unraveled, and the respective outer member 3' is sawed all the way through.

After the outer member 3' has been severed, a tubular supporting element 5 is slid over the rearward end portion 1*a* of the tension part 1, subsequently to be anchored in the earth or structure, until the supporting element 5 just covers the point of severance 4. There-upon, the central member 2 is also severed on the side of the supporting element near the end of the tension part 1 at point 24. The supporting element 5 is then subjected to forces directed radially inwards, whereby the supporting element 5 is pressed fast against the tension part 1 through angular extruding. In the present embodiment, the severance point 24 of central member 2 lies on the side of the supporting element 5 which is remote from the point of severance 4, towards the end of the tension part 1 and not covered by supporting element 8. Between the inside surface of the tubular supporting element 5 and the tension part 1 there is an insert 11 made of a harder material than the supporting element 5 and the tension part 1. The surface of the insert 11 resting against the outer members 3 of the tension part 1 is provided with teeth 13 for secure gripping of the tension part 1.

The length L of the supporting element 5 is about four to six times the diameter of the tension part 1, and the distance $L_1$ from the point of severance 4 to the end of the supporting element 5 remote from the rearward end of the tension part 1 is, in the embodiment of FIG. 1, about one-twentieth of the length L of the supporting element 5. However, the point of severance 4 may be situated in a range of ½L in front of or behind the mentioned end of the supporting element 5.

Disposed directly in front of the supporting element 5 is a plate 8 serving as a buttress for bracing the supporting element 5. Into the earth surrounding that portion 1*a* of the tension part 1 to the right of the plate 8, as viewed in FIG. 1, a cement emulsion is later injected to form a soil body (not shown) for producing a soil anchor.

FIG. 3 shows the tension part 1 depicted in FIGS. 1 and 2, the major part of which has been separated from the supporting element 5 held in the soil body (not shown) by exerting a load P on the free end of the tension part 1.

FIG. 3 shows that the outer members 3 not severed in the state of use of the anchor are broken in the vicinity of the point of severance 4 of the outer member 3' completely severed from the outset. Contrary thereto, the segment of the central member 2 originally situated in the portion 1*a* of the tension part 1 has not been broken but withdrawn from the portion 1*a*.

Tests have shown than the elongation of the tension part 1 according to FIG. 1 until breaking is about five times that of the tension part described in the earlier mentioned U.S. Pat. No. 4,884,377, in which at least the central member is completely severed, the dimensions of the tension part, i.e., its length and the diameter of the central member and outer members, being the same.

Higher ductility, i.e., a plastic deformation of the tension part 1, is particularly advantageous for early recognition, by means of a visible displacement of the anchor head, of any forces occurring additionally after prestressing, e.g., as a result of the pressure of the earth on the anchor.

The tension part 1 illustrated in FIG. 4 has a central steel rod 10 and six outer steel members 9 of which the members 9' are completely severed at the points 4 and 6. In order for the steel members 9 and 10 to run uniformly and parallel to one another, they are held together at regular intervals by collets 7, only one of which is shown in FIG. 4. The rearward portion 1*a* of the tension part 1 is compressed and held fast by the tubular supporting element 5. The points of severance 4 and 6 are situated at a distance of about one-fourth the length of the supporting element 5 in front of the latter.

FIG. 5 shows the part of the tension part 1 separated from the anchored portion 1*a* by the action of a load greater than the working load, the four outer steel rods 9, only two of which are visible, being broken by the greater stress. As in the embodiment illustrated in FIG. 3, the part of the central steel rod 10 originally situated in the portion 1*a* has been withdrawn from the portion 1*a*.

Illustrated in FIG. 6 is a further embodiment of the tension part 1 according to the invention, made up of a stranded steel wire having a central member 2 and outer members 3, as in the embodiment of FIGS. 1 and 2. Adjacent to supporting element 5' is the plate 8 serving as a buttress. This plate has the same function as the anchor plate of a soil anchor. The supporting element 5' surrounding the portion 1*a*, intended for anchoring, of the tension part 1 has a bore 12 widening towards the rear, i.e., towards the right as viewed in FIG. 6, in which there are two wedges 14 and 15 having inner teeth 16 for gripping the portion 1*a* of the tension part 1.

The point of severance 4 of the outer member 3' is set back about one-seventh of the length of the supporting element 5' from the front end of the latter. The active part of the tension part depicted in FIG. 6 is surrounded by a casing pipe 17, and the space between the tension part 1 and the inside of the casing pipe 17 is filled with a lubricant 18 for facilitating both prestressing and extraction of the active part of the tension part 1. Such a casing pipe 17 may also be provided in the embodiments shown in FIGS. 1 and 4.

The supporting elements 5 with the associated points of severance 4 may also be disposed at a location of the active part of the tension part 1. Such embodiments (not shown) have an extended passive portion, i.e., the portion to be anchored. Upon the application of a load, all non-severed outer members of such a tension part break in the region of the supporting element 5 so that the tension part can for the most part be removed from the earth or structure for the purpose of reuse, if need be.

What is claimed is:

1. A method of producing a tension part anchorable in the earth or in a structure, capable of being stressed, having a central member about which outer members are disposed, a first end and a second end, said second end intended to be inserted into said earth or structure, said tension part intended to be removed for the most part from the earth or the structure after use, comprising the steps of:

completely severing at least one of the outer members of the tension part at a first pre-determined point, completely severing the central member of said tension part at a second pre-determined point, and pressing a support element, having a first and second end, said ends corresponding to the respective first and second ends of said tension part, substantially radially about the tension part and in such way that the first predetermined point of severance lies within a range of approximately ½ the length of said supporting element on either side of said first end of said supporting element and said second predetermined point of severance lies beyond said second end of said supporting element.

2. The method of claim 1, comprising the further step of severing an additional outer member in the vicinity of said first predetermined point of severance.

3. The method of claim 1 wherein said second predetermined point of severance, lies between said second end of said supporting element and said second end of said tension part.

* * * * *